United States Patent [19]

Tada

[11] Patent Number: 4,524,888

[45] Date of Patent: Jun. 25, 1985

[54] DISPENSER

[75] Inventor: Tetsuya Tada, Tokyo, Japan

[73] Assignee: Canyon Corporation, Tokyo, Japan

[21] Appl. No.: 401,902

[22] Filed: Jul. 26, 1982

[30] Foreign Application Priority Data

| | | | |
|---|---|---|---|
| Jul. 30, 1981 | [JP] | Japan | 56-119816 |
| Jul. 31, 1981 | [JP] | Japan | 56-120097 |
| Jul. 31, 1981 | [JP] | Japan | 56-120098 |
| Jan. 13, 1982 | [JP] | Japan | 57-3684 |
| Jan. 18, 1982 | [JP] | Japan | 57-5726 |
| Feb. 12, 1982 | [JP] | Japan | 57-20794 |
| Feb. 18, 1982 | [JP] | Japan | 57-25142 |
| Apr. 6, 1982 | [JP] | Japan | 57-56870 |
| Apr. 27, 1982 | [JP] | Japan | 57-70713 |

[51] Int. Cl.[3] ..... B67B 5/00

[52] U.S. Cl. ..... 222/153; 222/321

[58] Field of Search ..... 222/153, 251, 320, 321, 222/336, 340, 341, 372, 491, 494, 495, 496, 182

[56] References Cited

U.S. PATENT DOCUMENTS

| | | | |
|---|---|---|---|
| 3,306,497 | 2/1967 | Kenney et al. | 222/182 |
| 3,884,393 | 5/1975 | Wassilieff | 222/153 |
| 3,892,326 | 7/1975 | Schneible | 222/153 |
| 4,174,055 | 11/1979 | Capra et al. | 222/340 |
| 4,197,960 | 4/1980 | Walter | 222/153 |
| 4,340,158 | 7/1982 | Ford et al. | 222/321 |
| 4,341,318 | 7/1982 | Smalley | 215/211 |
| 4,369,899 | 1/1983 | Magers et al. | 222/321 |
| 4,375,266 | 3/1983 | Magers | 222/321 |
| 4,377,106 | 3/1983 | Workman et al. | 222/153 |

FOREIGN PATENT DOCUMENTS 48-29402 9/1973 Japan .

*Primary Examiner*—Joseph J. Rolla
*Assistant Examiner*—Kenneth Noland
*Attorney, Agent, or Firm*—Frishauf, Holtz, Goodman & Woodward

[57] ABSTRACT

Disclosed is a dispenser which has a piston attached to its head and a cylinder attached to its cap and which is constructed so that it may be fitted onto a vessel through the cap and so that it may, in accordance with the sliding movement of the piston, suck up a liquid in the vessel into the cylinder through a primary valve and pressurize the liquid to cause the same to issue outside the dispenser through a secondary valve. The dispenser has a child-proofing mechanism including a protruded portion formed on the cap and having an engagement groove and an engagement projection formed on the inner wall surface of the head and, by being rotated with the piston located at its depressed position, engaged with the engagement groove of the protruded portion to lock the piston made integral with the head to its depressed position. An engagement projection or engagement groove is formed on or in the outer wall surface of the cap. An engagement groove or engagement projection is formed in or on the head engageably with the engagement projection or engagement groove of the cap. The dispenser has a mechanism for preventing the rotation and rising movement of the head, formed on a virgin seal removably disposed between the cap and the head.

5 Claims, 29 Drawing Figures

DISPENSER

BACKGROUND OF THE INVENTION

This invention relates to a dispenser which is designed, by the sliding movement of a piston, to suck up a liquid in a vessel such as insecticide, neutral detergent or cosmetic liquid into a cylinder and pressurize the liquid to jet in from an orifice.

With a piston attached to its head and with a cylinder attached to its cap, this type of dispenser is attached to a vessel through the cap. And the dispenser is constructed such that by, for example, depressing the head the piston is lowered, thereby jetting the liquid. That is, by depressing the head, the piston is caused to make a sliding movement and the liquid is thereby jetted. This type of dispenser, therefore, is required to be packed and transported so as to prevent the head from being depressed at a time preceding to the commencement of the actual use. Further, where the dispenser is exhibited in a store, it is necessary to prevent the head from being depressed due to carelessness or fall to permit the emanation of the liquid from the dispenser. Namely, it is demanded that the dispenser be subjected to what is called "virgin-lock" directed to preventing the unnecessary or careless depression of the head at a time preceding to the commencemennt of its actual use. Further, if the dispenser can be packed as compactly as possible when taken in its axial direction, it can be transported with high efficiency, thereby reducing the cost of transportation. Even after the commencement of the actual use, it is demanded that the dispenser be equipped with a locking means, or what is called "child-proof" means, intended to prevent the depression of the head at a time of non-use so as to safeguard children against the possible accidents.

Known is a dispenser of the type wherein a removable virgin seal is provided on the upper part of the head. In this type of dispenser, even if the head is erroneously depressed, it is not actually depressed by being obstructed due to the existence of the virgin seal. This virgin-lock can be released by removing or exfoliating the virgin seal. As an example of this type of dispenser, there is a dispenser of U.S. Pat. No. 3,306,497 (patented on Feb. 28, 1967 and invented by A. Kenney et al). In the dispenser virgin-locked by means of virgin seal, the head can be freely depressed after removal of the virgin seal. Therefore, the dispenser is not made child-proof. Further, the head is usually kept at its raised position and as a result the dispenser can not be compactly packed in its axial direction.

A dispenser has been also proposed which is equipped with a locking means serving both as a virgin-locking means and as a child-proofing means. According to Japanese Patent Publication No. 48-29402 (published on Sept. 10, 1973, the Applicant: Kalmer Incorporated), an externally threaded portion is provided on the outer circumferential surface of the head, while an internally threaded portion is provided on the inner circumferential surface of the cylinder. And by depressing the head and screwing it into the cylinder, the dispenser is virgin-locked and child-proofed. When this screw engagement is released, the head is raised and brought to a depressible position. In the state of screw-engagement, the head is locked at its lowered or depressed position, thereby providing a merit that the dispenser can be packed compactly in its axial direction. When the head is raised and thus located at its depressible position, however, the externally threaded portion of the head is exposed, thereby providing a demerit that the dispenser fails to have a good appearance.

SUMMARY OF THE INVENTION

It is accordingly a first object of the invention to provide a dispenser wherein the head is locked by other method than the above-mentioned screw engagement, thereby virgin-locking and child-proofing the dispenser.

It is a second object of the invention to provide a dispenser wherein a removable virgin seal is disposed not on the upper part of the head but between the head and cap.

It is a third object of the invention to provide a dispenser wherein, when the head is locked, a primary valve is forcibly pressed against a valve seat.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

DETAILED DESCRIPTION OF THE PREFERRED EMBODIMENTS

Figure 1:
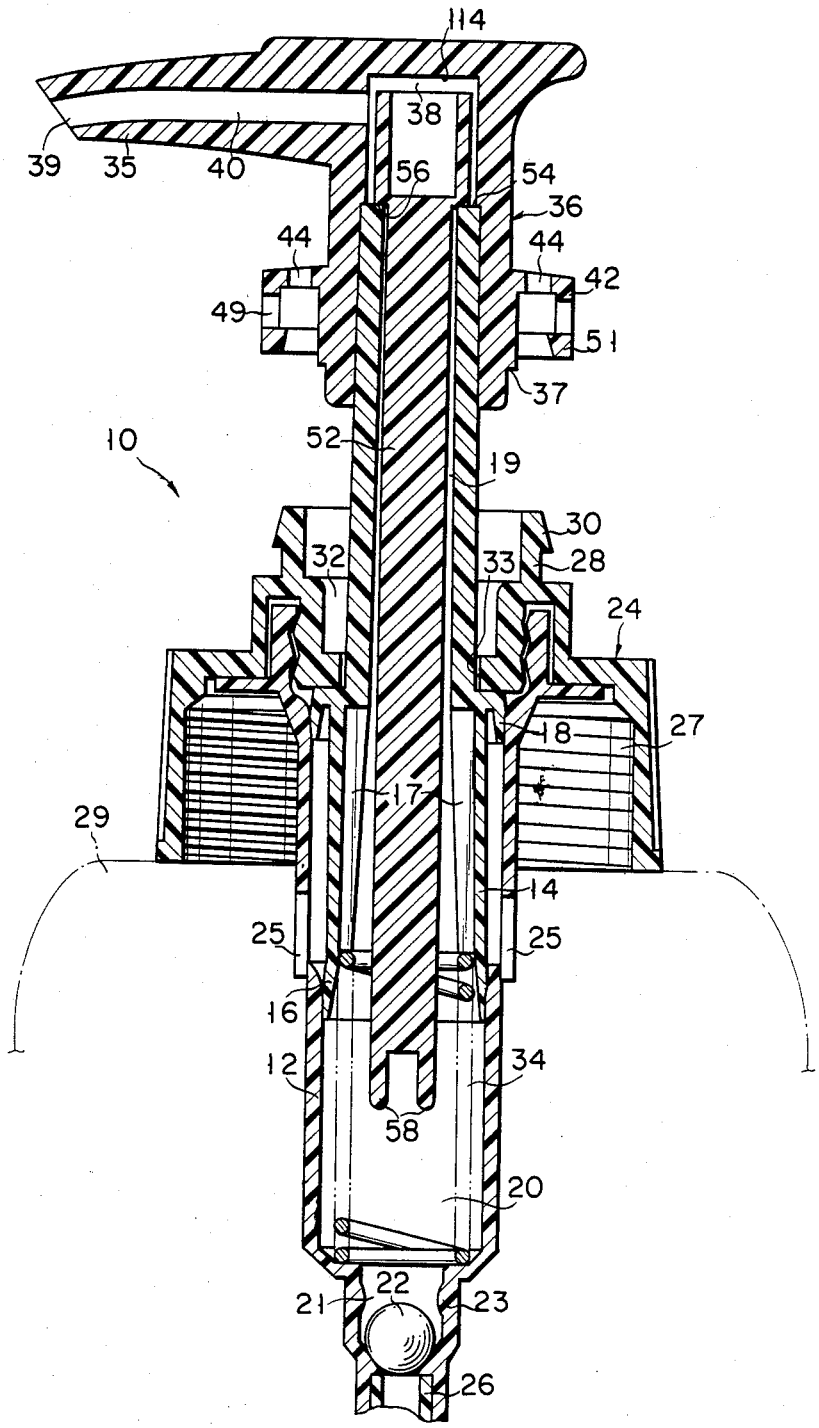
FIG. 1 is a longitudinal sectional view of a dispenser according to a first embodiment of the invention, wherein the head is located at its raised position.

As shown in FIG. 1, a dispenser 10 according to a first embodiment of the invention is provided with a stepped cylinder 12, in which a piston 14 is disposed so that it can be raised and lowered. It is to be noted here that the piston 14 is not limited to making a vertical reciprocating movement, i.e., up-and-down movement but may be arranged to make other reciprocating movements such as, for example, a horizontal reciprocating movement. The piston 14 has skirt-like seals 16 and 18 at its lower end portion and intermediate portion, respectively. The skirt-like seal 16 slides along a small-diameter portion of the cylinder 12, while the skirt-like seal 18 along a large-diameter portion of the cylinder 12. It is to be noted here that the skirt-like seal 18 acts as a negative pressure preventive seal. The piston 14 has a flow path 19, which communicates with a variable chamber 20 defined by the movable piston 14 and stationary cylinder 12. At the lower end portion of the cylinder 12, there is provided a flow path 21 communicating with the cylinder 12. In this flow path 21, there is disposed a ball valve 22 constituting a primary valve. The ball valve 22 is given a limit, by four protruded portions 23 equiangularly formed on the inner circumferential surface of the cylinder 12, so that its mmovement may be regulated in relation to the flow path 21. It is to be noted here that the primary valve is not limited to the ball valve but may be another valve, such as a plate-like valve. At the lower end portion of the large-diameter portion of the cylinder 12, four negative pressure preventive apertures 25 are formed at circumferentially equidistant positions, respectively. On the upper end portion of the cylinder 12, a cap 24 is fitted, and into the lower end portion of that cylinder, a suction pipe 26 is fitted. The cap 24 has an internally threaded portion 27 in its inner face, which is screwed onto a mouth portion (not shown) of a vessel 29 in which a liquid such as, for example, insecticide is received. Further, the cap 24 has an annular protruded portion 28 formed concentrically with the cylinder 12 and protruded upwards. An engaging pawl 30 is formed along the outer circumferential surface of that protruded portion 28 at the upper end portion thereof. Further, the cap 24 is formed with a bottomed hole 32, the bottom of which is formed with a through hole 33. The piston 14 is passed through this hole 33 and extending upwardly. The piston 14 is upwardly urged by a compression coil spring 34 disposed inside the cylinder 12 and its raised position is set by abutment of its skirt-like seal 18 onto the underside of the cap 24. It is to be noted here that the upper end of the compression coil spring 34 abuts on the lower end of an internal rib 17 inside the cylinder 12.

Onto the upper end portion of the piston 14, there is attached a head 36 provided with a nozzle 35, the head being designed to conduct an up-and-down operation integrally with the piston. The head 36 has a shoulder 37 and is lowered until this shoulder abuts onto the cap 24 as described later. Further, the head 36 is formed with a vertically extending flow path 38 and a horizontally extending flow path 40 communicating with the flow path 38 and also communicating with the open air through an orifice 39 of the nozzle 35. Further, the head 36 is integrally provided with a bottomed cylinder-like virgin seal 42.

Figure 2:
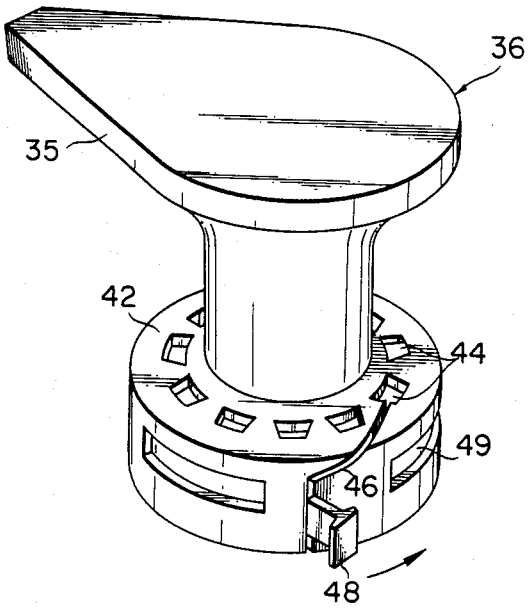
FIG. 2 is a perspective view of the head and virgin seal.

As shown in FIG. 2, the virgin seal 42 has a series of trapezoidal exfoliating grooves 44 formed in the bottom of the bottomed cylinder so that they may be disposed at circumferentially equidistant positions, and an exfolidating groove 46 communicating with one of the series of exfoliating grooves and extending across the side wall of the bottomed cylinder. It is to be noted here that the exfoliating groove 44 is not limited to a trapezoidal shape but may be of a rectangular or angular shape. The virgin seal 42 has a projection 48 formed, adjacent to the exfoliating grooves 46, on the side wall of the bottomed cylinder so as to project from this side wall. If this projection 48 is pulled in a direction indicated by the arrow, the virgin seal 42 is broken along the series of exfoliating grooves 44, so that the virgin seal 42 can be easily removed from the head 36. The virgin seal 42 has a plurality of elongate apertures 49 formed in the side wall of the bottomed cylinder equidistantly in the circumferential direction thereof, the radial deformation thereof being thus made easy. As shown in FIG. 1, the virgin seal 42 has an engaging pawl 51 on the inner circumferential surface of the lower end portion of the bottomed cylinder, said engaging pawl being formed engageably with the engaging pawl 30 of the cap 24.

Figure 3:
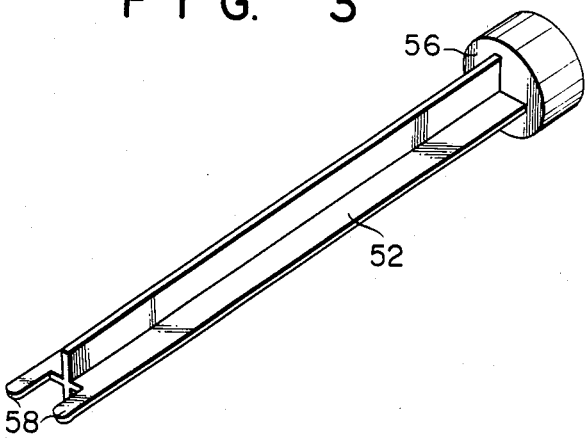
FIG. 3 is a perspective view of a valve spindle.

As shown in FIG. 1, in the flow path 19 formed in the piston 14, a valve spindle 52 is disposed so that it may make an up-and-down movement, and its upper end extends into the flow path 38. The valve spindle 52 has a shoulder 56, which is formed so that it can abut on the upper end 54 of the piston 14. The shoulder 56 acts or serves as a secondary valve and, by abutting on the upper end 54, serving as a valve seat, of the piston 14, renders the communication between the flow path 19 and the flow path 38 ineffective. The valve spindle 52, except for its upper end portion, is formed, as shown in FIG. 3, so that its cross section may be in the form of a cross. Therefore, the flow of the liquid in the flow pat 19 is made smooth. It is to be noted here that a blind hole formed in the upper end portion of the valve spindle 52 is so intended that when forming the valve spindle the upper end portion thereof may be cooled easily. At the lower end portion of the valve spindle 52, for example, two pressing members 58 are formed integrally with the valve spindle and, as later described, when the piston 14 is lowered, press the primary valve 22. The pressing members 58 are not limited to two in number but may be formed more in number, if necessary.

Figure 4:
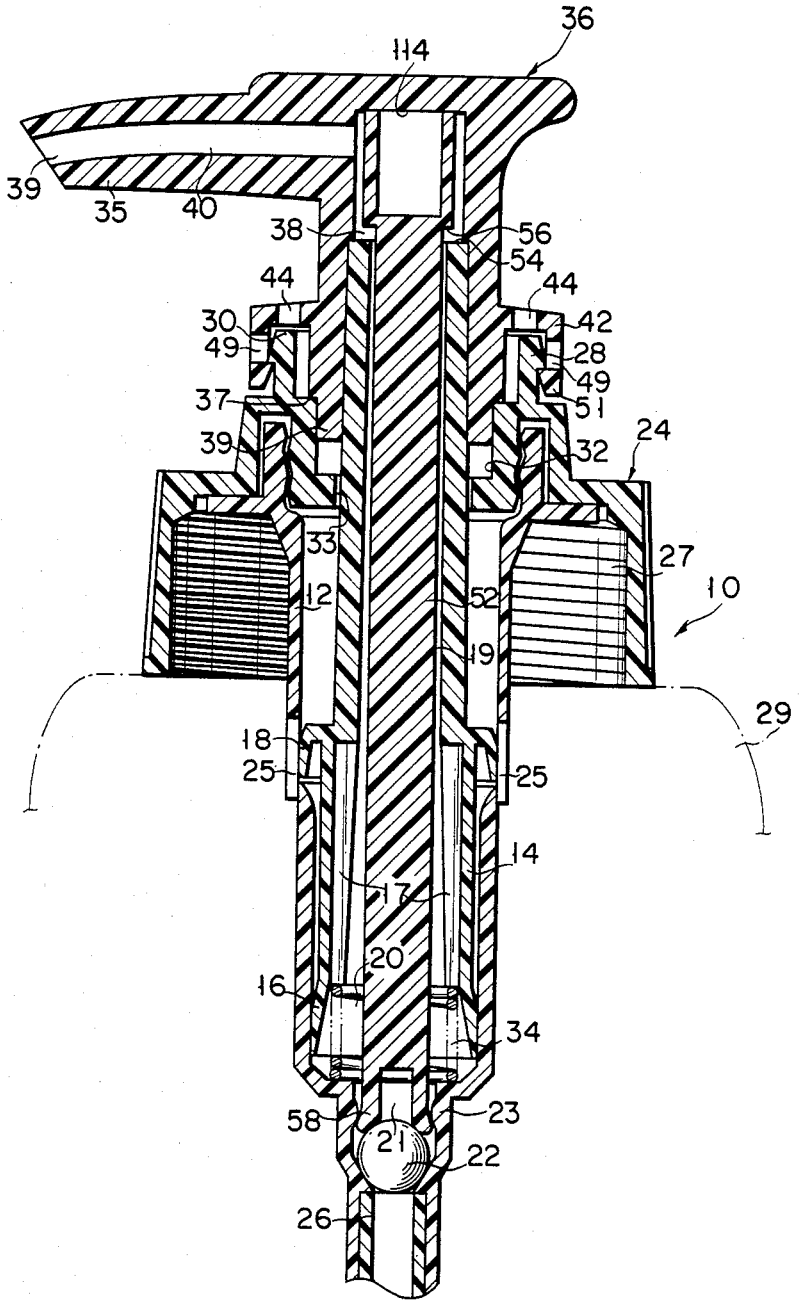
FIG. 4 is a longitudinal sectional view of the dispenser shown in FIG. 1, wherein the head is lowered and locked.

In the dispenser 10 having the foregoing construction, when the head 36 is depressed against the urging force of the compression coil spring 34, the piston 14 is lowered together with the head as shown in FIG. 4. When the head 36 is lowered, the engaging pawl 51 of the virgin seal 42 formed integrally with the head is brought into engagement with the engaging pawl 30 of the cap 24. Since the engaging pawls 30 and 51 have tapered faces and virgin seal 42 has the elongate aperture 49, the engagement between the virgin seal 42 and the cap 24 is smoothly performed even with a small depressing force. However, once that engagement has been achieved, since it is an engagement between the engaging pawls 30 and 51 having the tapered faces, the virgin seal 42 is firmly engaged with the cap 24. Thus, the rising movement of the head 36 and the piston 14 if totally regulated. That is, the piston 14 is locked to its lowered position.

By the fall of the piston 14, the upper end of the valve spindle 52 abuts on an inner face 114 of the head 36 and the pressing members 58 formed at the lower end of the valve spindle press the primary valve 22. By pressing the primary valve 22, the lower ends of the pressing members 58 are elastically defomed and bent in the radially outward direction, and are thus clamped between the primary valve 22 and the protruded portions 23. When the primary valve 22 is pressed by the pressing members 58, the communication between the flow path 21 and the suction pipe 26 is rendered ineffective. Thus, it is impossible that the liquid in the vessel 29 flows exteriorly of the dispenser 10 through the flow path 21. Since, in this way, the piston 14 is locked to its lowered position as shown in FIG. 4, even when the dispenser 10 is caused to fall or inverted vertically, the head 36 is not depressed. Thus, the dispensation of the liquid from the dispenser is prevented. Further, the entire longitudinal length of the dispenser 10 can be made small, so that the dispenser 10 can be packed compactly.

In the state wherein the virgin seal 42 is engaged with the cap 24 and the piston 14 is locked to its lowered position, that is, in the state wherein the dispenser 10 is kept as shown in FIG. 4, the dispenser 10 is packed and transported or exhibited in a store. When the dispenser 10 is put to actual use, the projection 48 of the virgin seal 42 is pulled in the direction indicated by the arrow of FIG. 2. Then, the virgin seal 42 is sequentially exfoliated from the head 36 along the exfoliating grooves 46 and 44. By the exfoliation of the virgin seal 42 from the head 36, the engagement between the head and cap 24 is released and as a result the rising operation of the piston 14 is permitted. Thus, the piston 14 is upwardly moved due to the urging force of the compression coil spring 34, and the dispenser 10 is made usable.

The operation of the dispenser 10 made usable as mentioned above will now be explained as below.

For the purpose of causing the diepensation of the liquid, as indicated by the transition of the state shown in FIG. 1, to the state shown in FIG. 4, the head 36 is depressed, thereby lowering the piston 14 against the urging force of the compression coil spring 34. It is to be noted here that at this time the virgin seal 42 is already exfoliated from the head 36 and the variable chamber 20 is assumed to be full of the liquid. As the piston 14 is lowered, the total volume of the variable chamber 20 is reduced with a result that the liquid therein is pressurized or subjected to application of the pressure. This pressure is increased by degrees and the liquid thus highly pressurized pushes up the valve spindle 52. It is to be noted here that at this time the primary valve 22 is downwardly pressed by the pressurized liquid, thereby making the communication between the flow path 21 and the suction pipe 26 ineffective. By pushing up the valve spindle 52, its shoulder portion 56 is separated from the upper end 54, thereby providing a state wherein the secondary valve is opened. Thus, the flow path 19 is allowed to communicate with the flow path 38. Thus, the pressurized liquid in the variable chamber 20 is allowed to flow into the flow path 40 through the flow paths 19 and 38 and is thus allowed to issue from the orifice 39 of the nozzle 35. It is to be noted here that by equipping the orifice 39 with a spinner or foaming means, the dispenser 10 can be used as a sprayer or a foaming instrument. The head 36 is lowered until its shoulder portion 37 abuts against the cap 24. Since its upper end abuts on the inner wall surface 114 of the head, the valve spindle 52 is lowered jointly with the head 36. As a result, the pressing members 58 press the primary valve 22 downwardly. The lower end portions of the pressing members 58 are elastically deformed and thus outwardly curved, and are thus clamped between the primary valve 22 and the protruded portions 23. The air allowed to flow in the large-diameter portion of the cylinder 12 through the holes 32 and 33 flows into the vessel 29 through the negative pressure preventive apertures 25, thereby preventing the vessel interior from having a negative pressure.

Thereafter, when the depressing force applied to the head 36 is removed, the piston 14 is allowed to rise jointly with the head 36 by the urging force of the spring 34. At this time, since the lower end portions of the pressing members 58 of the valve spindle 52 are clamped between the primary valve 22 and the protruded portions 23, the valve spindle 52 is not initially allowed to rise even if the piston 14 and head 36 rise. But, when the piston 14 rises and the upper end 54 thereof abuts on the shoulder 56, the valve spindle 52 rises jointly with the piston. Accordingly, in the state wherein the shoulder 56 of the valve spindle 52 is kept to abut on the upper end of the piston 14, namely, in the state wherein the communication between the flow path 19 and the flow path 38 is kept ineffective, both the piston and the valve spindle rise together. As the piston 14 rises, the total volume of the variable chamber 20 increases as compared with that when previous dispensation of the liquid is completed. Thus, the interior of the variable chamber 20 has a negative pressure. The primary valve 22, therefore, is upwardly moved until its abuts on the protruded portions 23, by a suction force created in the variable chamber 20. Accordngly, the liquid in the vessel 29 is allowed to flow into the variable chamber 20 through the suction pipe 26 and the flow path 21. Thus, the preparation for the next issue of the liquid is completed, and the issue can be continuously made, if necessary. It is to be noted here that since as above stated the piston 14 rises in the state wherein the communication between the flow paths 19 and 38 is kept ineffective, it is impossible that the air enters the variable chamber 20 through the orifice 39 and liquid paths 40 and 38. Further, since the negative pressure in the vessel 29 is released by entry of the air thereinto through the negative pressure apertures 25, entry of the liquid into the variable chamber 20 is reliably made.

Figure 5:
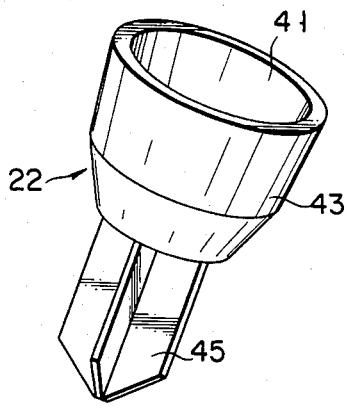
FIG. 5 is a perspective view showing a modification of the primary valve.
Figure 6:
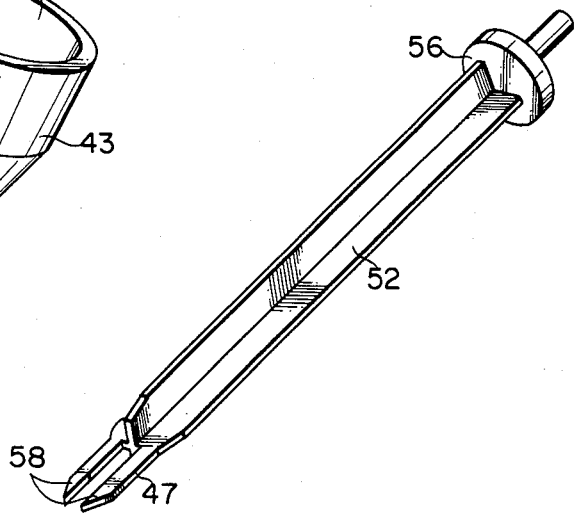
FIG. 6 is a perspective view showing a modification of the valve spindle.
Figure 7:
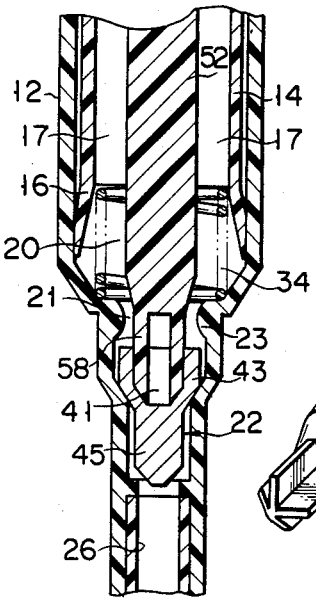
FIG. 7 is a partial view in longitudinal section of the dispenser having the modified primary valve and valve spindle incorporated thereinto, wherein the head is lowered and locked.
Figure 8:
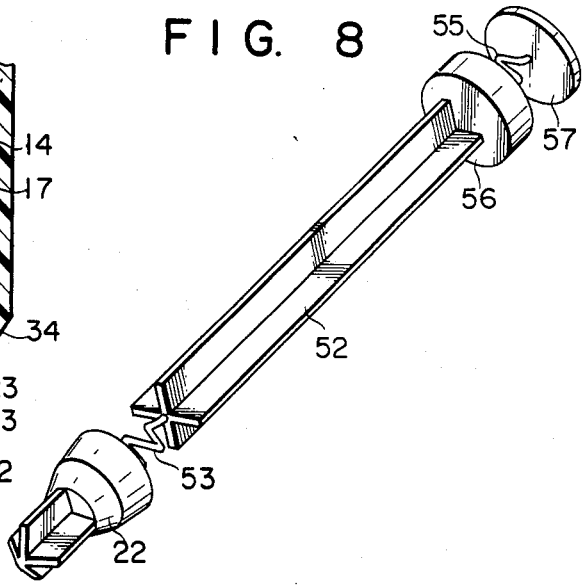
FIG. 8 is a perspective view showing another modification of the valve spindle.

In the above-mentioned embodiment, the primary valve 22 uses the ball valve, but can also use a valve of such a shape as shown in FIG. 5. This type of valve has a valve body 43 provided with a blind hole 41 and a guide 45 having a cross section. In the case of using this primary valve, as shown in FIG. 6, the pressing portions 58 of the valve spindle 52 engage with the blind hole 41. FIG. 7 shows a state wherein the primary valve 22 is disposed in the flow path 21. In FIG. 7, the piston 14 is located at its lowered position and the pressing members 58 are fully inserted into the blind hole 41, thereby elastically pressing the primary valve 22. Therefore, the communication between the suction pipe 26 and the flow path 21 is reliably made ineffective by the primary valve 22. Simultaneously, the pressing members 58 are engaged with the inner face of the blind hole 41. The engaging face of the pressing members is formed with a frictional engagement means such as mesh patterns made by knurling fablication (see FIG. 6). And when the piston 14 rises jointly with the head 36 and its upper end 54 abust on the shoulder portion 56 of the valve spindle 52, the valve spindle rises jointly with the piston 14. Further, since the pressing members 58 are kept in frictional engagement with the blind hole 41 of the primary valve 22, when the valve spindle 52 rises, the primary valve 22 is raised by the pressing members until it abuts on the protruded portion 23. Accordingly, the suction pipe 26 is allowed to communicate with the flow path 21. In this way, by its frictional engagement with the pressing members 58, the primary valve 22 at the time of the valve spindle 52 rising is forcibly raised. At this time, therefore, no erroneous operation occurs, and thus the communication between the suction pipe 26 and the flow path 21 is reliably made effective. It is to be noted here that mesh patterns may be also formed on the inner face of the blind hole 41. In this case, a more reliable frictional engagement is achieved. In this construction wherein the opening or closing of the primary valve is forcibly carried out by the rise or fall of the head 36, a merit is produced not only of obtaining a reliable opening or closing of the primary valve, but also of obtaining a greater tolerance, permissible attaching error, etc. of the associated members. It is to be noted here that, as shown in FIG. 8, the valve spindle 52 may be connected to the primary valve 22 through an elastic member such as a wavy spring 53. In this case, in the state wherein the piston 14 is locked to its lowered position as shown in FIG. 4, the wavy spring 53 downwardly urges the primary valve 22 and causes the same to abut on the valve seat. Thus, the engagement between the variable chamber 20 and the interior of the vessel 29 is reliably made ineffective. On the upper end of the valve spindle 52, there is formed a second elastic member such as, for example, a wavy spring 55, on the extending end of which a support plate 57 is formed. Since the support plate 57 abuts on the inner wall surface 114 of the head 36, this wavy spring 55 downwardly urges the valve spindle 52, that is, urges the same in the direction in which its shoulder portion 56 abuts on the upper end 54 of the piston 14 to render the communication between the flow path 19 and the orifice 39 ineffective. In the state of FIG. 4 wherein the piston 14 is locked to its lowered position, the wavy spring 53 is compressed to urge the primary valve 22 downwardly and at the same time to urge the valve spindle 52 upwardly. For this reason, by setting, for example, the spring constant to a suitable value, the wavy spring 55 has an urging force greater than that of the wavy spring 53 so as to downwardly urge the valve spindle 52 against the urging force of the wavy spring 53 and thereby make the communication between the flow path 19 and the liquid outlet 39 ineffective. And the primary valve 22, wavy spring 53, valve spindle 52, wavy spring 55 and support plate 57 are integrally formed of synthetic resin.

In this way, since the primary valve 22, secondary valve, and first and second elastic members 53 and 55 are integrally formed, the parts of the dispenser are reduced in number. As a result, the manufacturing cost of the dispenser is reduced and at the same time the assembling operation thereof is simplified. Further, the first elastic member 53 elastically connecting the primary and secondary valves, when the piston is located at its lowered position, urges the primary valve in the direction of making the communication between the vessel and the cylinder ineffective. Simultaneously, this first elastic member 53, in accordance with the rise of the piston 14, rises jointly with the same and thereby raises the primary valve 22 in the direction of making the communication between the vessel and the cylinder effective. That is to say, the first elastic member 53 acts not only as the urging member but also as the raising member. Thus, the opening operation of the primary valve 22 is reliably carried out without any erroneous operation. And the first elastic member, as mentioned above, has the two functions and is effectively utilized. In addition, since the primary valve 22 is connected by this first elastic member 53 to the secondary valve and the other elastic member 55 is provided on the upper end of the secondary valve, the associated members can be designed with greater tolerance, permissible attaching errors, etc.

Figure 9:
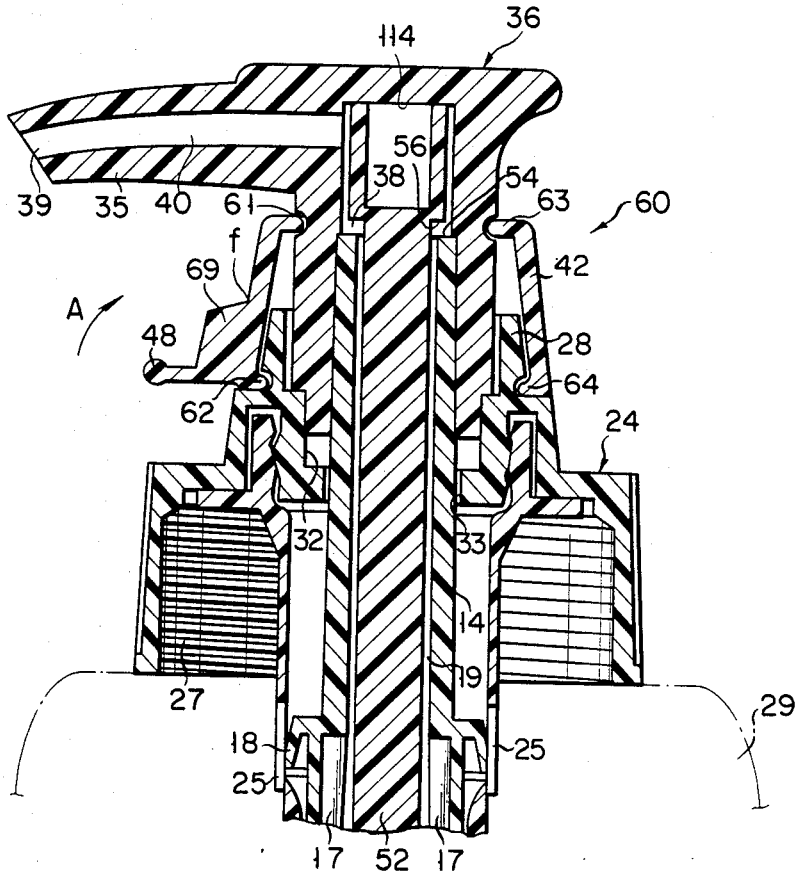
FIG. 9 is a longitudinal sectional view of the dispenser according to a second embodiment of the invention, wherein the head is lowered and locked.

In FIG. 9, the dispenser 60 according to a second embodiment of the invention is shown. In this dispenser 60, an annular engagement groove 61 is formed in the outer circumferential surface of the head 36. An annular engagement groove 62 is also formed in the outer circumferential surface of the lower end portion of the annular body protruded portion 28 of the cap 36. The dispenser 60 comprises frust-conical virgin seal 42. The virgin seal 42 has at its upper end portion a first inwardly and horizontally extending annular engagement portion 63 and has at its lower end portion a second inwardly and horizontally extending annular engagement portion 64. The virgin seal 42 is integrally formed of plastics material such as polypropylene.

By engagement of its first engagement portion 63 with the engagement groove 61 formed in the head 36 and engagement of its second engagement portion 64 with the engagement groove 62 formed in the cap 24, the virgin seal 42 locks the piston 14 to its lowered position shown in FIG. 9. Therefore, even when the dispenser 60 is caused to fall or vertically inverted, it is impossible that the liquid in the vessel 29 issues exteriorly of the dispenser 60.

Generally, a plastic molding such as the virgin seal 42 has a property of orientation. For example, where the plastic molding is molded by injection molding, the molecules in the plastic are oriented in the direction in which the injection is carried out. Where this plastic molding is broken or torn, it can be easily done if in the direction of orientation but is difficultly done if otherwise.

Figure 10:
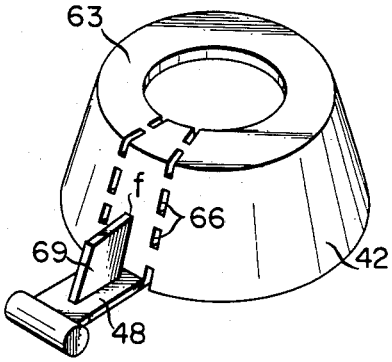
FIGS. 10 and 11 are perspective views showing modifications of the virgin seal, respectively.

In this embodiment, the virgin seal 42 is molded having a molecular orientation made in its axial direction. In view of the above, this virgin seal 42 is provided with a plurality of exfoliating grooves 66 formed in the direction of orientation, i.e., in the axial direction of the virgin seal. These exfoliating grooves 66 are formed in such a manner that they are spaced at prescribed intervals from each other in the direction of orientation, and in two parallel columns (FIG. 10). On the lower end portion of the virgin seal 42, an outwardly extending projection 48 and a rib 69 are formed between said two parallel columns as shown in FIG. 10. This projection 48 and rib 69 are formed integrally with the virgin seal 42. The virgin seal 42 constructed as above can be easily exfoliated from the dispenser 60 by pulling up the projection 48. That is, since the exfoliating grooves 66 are formed along the direction of plastic orientation, the virgin seal 42 is easily torn along the arrangement of the exfoliating grooves by pulling up the projection 48. That is, when the projection 48 is pulled up in the direction indicated by the arrow A of FIG. 9, the upper end of the rib 69 acts as a fulcrum f. Namely, the principle of leverage can be applied in this case. Thus, the projection 48 can be pulled up by a small force. Accordingly, the virgin seal 42 can be broken more easily.

Figure 11:
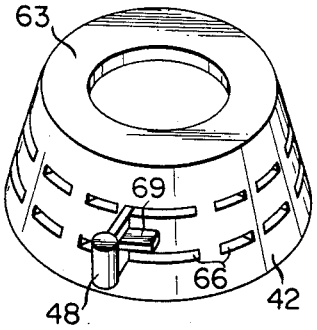

In the state wherein the piston 14 is locked by the virgin seal 42 to its lowered position as shown in FIG. 9, the dispenser 60 having the foregoing construction is transported or exhibited in a store. The virgin seal 42 may be also formed of other type of plastics than polypropylene, for example, polyethylene. Further, if they are formed along the direction of plastic orientation, the exfoliating grooves 66 formed in the virgin seal 42 may be formed along the circumferential direction of the same as shown in FIG. 11. In this case, the virgin seal 42 is vertically separated into upper and lower parts by an exfoliating operation. After this operation, the upper part is left intact on the head 36, and the lower part left intact on the cap 24. Further, the exfoliating groove 66 is not limited to the rectangular shape, but may be of a triangular or elliptical shape. Further, the exfoliating groove 66 may be increases or decreased in number if necessary. Further, the first and second engagements 63 and 64 are not limited to the annular configuration, but may be of any configuration if they are at least partially engaged with the head 36 and the cap 24, respectively.

Figure 12:
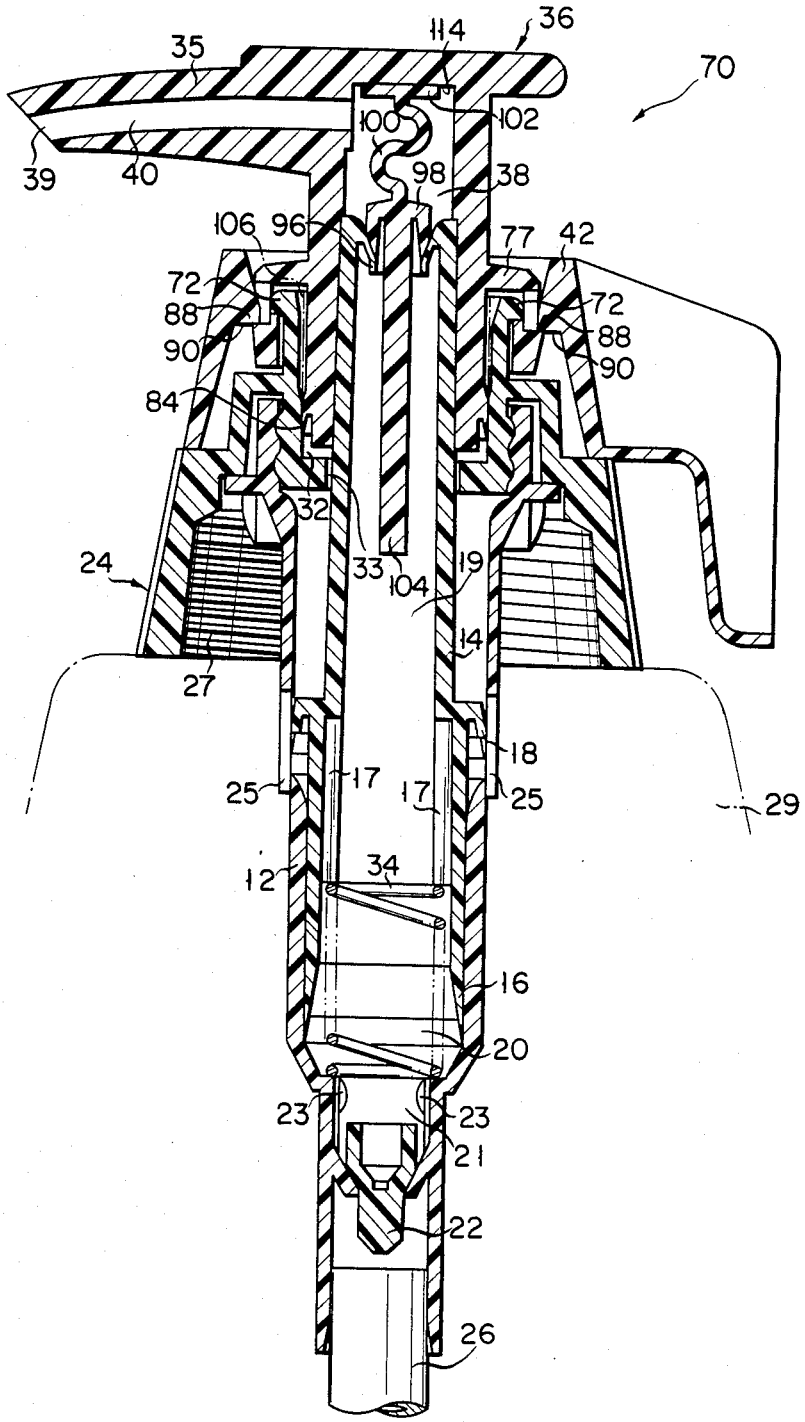
FIG. 12 is a longitudinal sectional view of the dispenser according to a third embodiment of the invention, wherein the head is lowered and locked.
Figure 13:
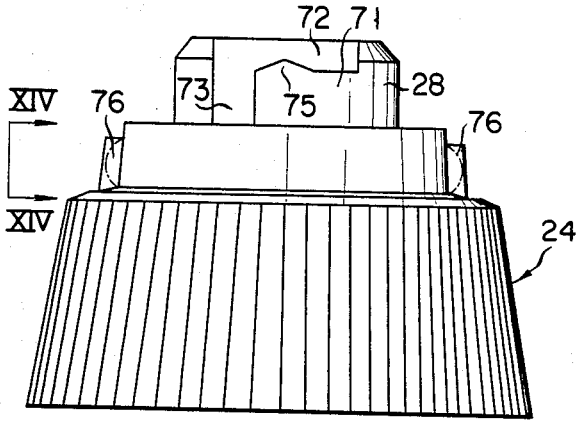
FIG. 13 is a front view of the cap.

A third embodiment of the invention is shown in FIG. 12. In this dispenser 70, two engagement grooves 71 spaced 180° from each other are formed on the outer circumferential surface of the upper end portion of the annular protruded portion 28 of the cap 24 (see FIG. 13 in which, however, only one is shown). As shown in FIG. 13, the engagement grooves 71 are formed by causing the outer circumferential surface of the protruded portion 28 to rise in the form of ⌐. As later described, a horizontal rise portion 72 of each engagement groove acts as a stopper for preventing the rise of the head 36, while a vertical rise portion 73 thereof acts as a stopper for preventing the rotation of the head. The engagement groove 71 has a triangular notch 75 formed in the horizontal rise portion 72. It is to be noted here that the engagement groove 71 is not limited to two in number but may well serve the purpose if it is provided at least one in number.

Figure 14:
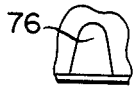
FIG. 14 is a partial side view of the cap taken along line XIV—XIV of FIG. 13.

As shown in FIG. 13, the cap 24 is provided with two engagement projections 76 spaced 180° from each other. The engagement projection 76 is formed into such a shape as, when a virgin seal 42 as later described is moved, for example, in the direction in which the piston 14 is pushed into the cap 24, permits a corresponding engagement groove of the virgin seal to engage with this engagement projection, that is, formed into a shape whose upper part is tapered (see FIG. 14).

Figure 15:
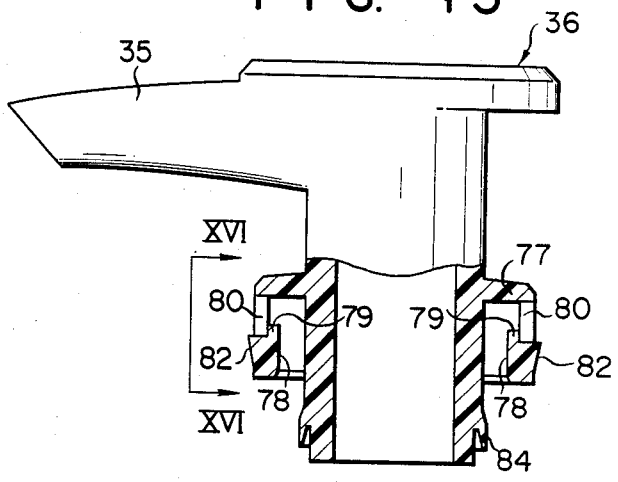
FIG. 15 is a partially cutaway front view of the head.
Figure 16:
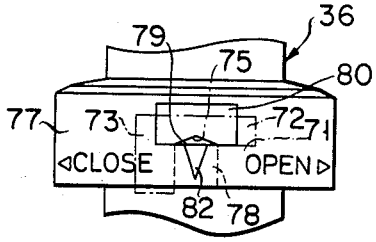
FIG. 16 is a partial side view of the cap taken along line XVI—XVI of the FIG. 15.

The head 36 is integrally formed with a cylindrical member 77 whose lower end is opened. As seen in FIGS. 15 and 16, the cylindrical member 77 has on its inner surface two engagement projections 78 spaced 180° from each other. Each projection 78 has at its upper end portion a triangular portion 79 engageable with the triangular notch 75 of the engagement groove 71 formed in the protruded portion 28 of the cap 24. As shown in FIG. 16, when the triangular portion 79 is brought into engagement with the triangular notch 75, the engagement projection 78 is allowed to abut on the vertical rise portion 73 surrounding the engagement groove 71, thereby preventing the head 36 from being rotated any further relative to the cap 24. That is, the vertical rise portion 73 acts as a stopper for preventing the rotation of the head 36. Rectangular windows 80 for confirming the engagement of the engagement projection 78 with the engagement groove 71 are respectively formed in the head 36 in such a manner that they are spaced 180° from each other. Further, indexes 82 of an inverted triangular shape are formed on the outer circumferential surface of the head 36 in such a manner that they are spaced 180° from each other. Further, the indications for indicating the rotational direction of the head 36 such as 'CLOSE', 'OPEN', etc. are given on the left and right sides of the index 82, respectively.

It is to be noted here that, as well seen in FIG. 15, the head 36 has on the outer circumferential surface of its lower end a skirt-like seal 84 for preventing the leakage of the liquid to occur at the time of, for example, the fall of the dispenser 70 and for preventing the vessel interior from having a negative pressure.

Figure 17:
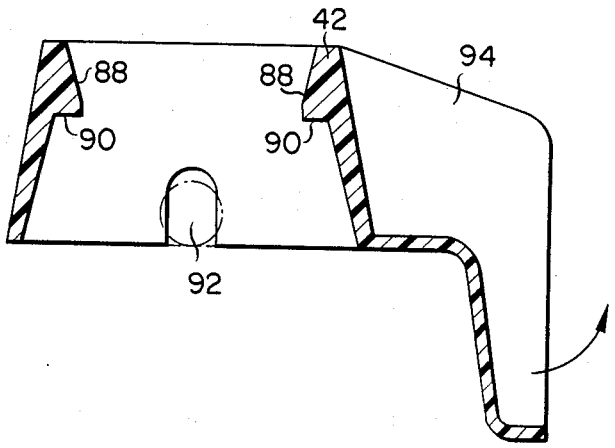
FIG. 17 is a longitudinal sectional view of the virgin seal.
Figure 18:
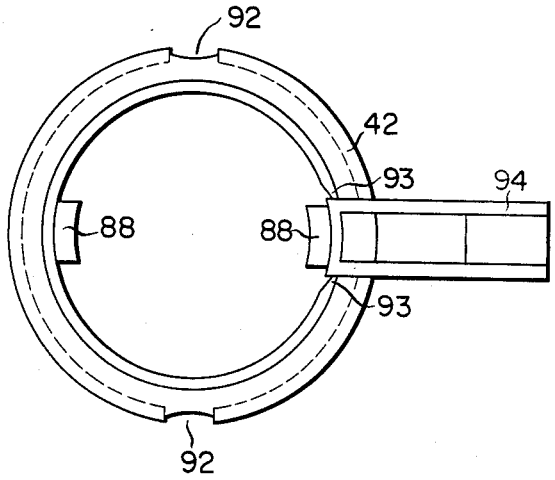
FIG. 18 is a top plan view of the virgin seal.

Further, the dispenser 70 is provided with a virgin seal 42 for preventing the unnecessary or careless depression of the head 36 prior to the commencement of its actual use (see FIG. 12). This virgin seal 42 is disposed between the cap 24 and the head 36 and so acts as to lock the head with respect to the cap. That is, as shown in FIGS. 17 and 18, the virgin seal 42 has on its inner circumferential surface a pair of 180° spaced engagement projections 88. Each engagement projection 88 is formed into such a shape as, when the virgin seal 42 is pressed in the moving direction of the piston 14, i.e., in the direction of depressing the head 36, permits this engagement projection to be brought into engagement with the corresponding window 80 of the head 24, thereby preventing the rotation of the same. It is to be noted here that, at the time of this engagement, the engagement projection 88 is temporarily deformed in the radially inward direction. The engagement projection 88 is formed into a rectangular shape having a shoulder portion 90, which is triangular in cross section. And the engagement projection 88 is formed slightly smaller in size than the window 80. For this reason, when the engagement projection 88 is brought into engagement with the corresponding window 80, it is prevented by this window from making a horizontally rotational movement. Thus, the rotation of the head 36 relative to the virgin seal 42 is prevented. That is to say, the window 80 acts as an engagement window. Further, by engagement of the lower edge of the window 80 of the head 36 against the shoulder portion 90 of the engagement projection 88, the rising movement of the head relative to the virgin seal is further prevented. Further, the virgin seal 42 has at its lower end a pair of engagement grooves 92 spaced 90° with respect to the engagement projections 88. Each engagement groove 92 may be of any shape if, at the time when the virgin seal 42 is moved in the direction of depressing the head 36, it is engageable with the corresponding engagement projection 76 of the cap 24 (see FIGS. 13 and 14).

Therefore, the engagement groove 92 is not limited to such a recess as in case of this embodiment. By engagement of the engagement groove 92 of the virgin seal 42 with the engagement projection 76 of the cap 24, the rotation of the virgin seal 42 relative to the stationary cap 24 is prevented. Further, by engagement of the engagement projection 88 of the virgin seal with the window 80 of the head 36 serving as an engagement groove, the rotation of the head 36 relative to the virgin seal is prevented. After all, the rotation of the head 36 relative to the cap 24 is prevented through the virgin seal 42. It is to be noted here that the rise of the head 36 is prevented by engagement of the engagement projection 88 of the virgin seal 42 with the lower edge of the engagement window 80 of the cap 24. The virgin seal 42 has a lever 94 integrally formed thereon through a pair of breaking edge 93. By being rocked in the direction indicated by the arrow of FIG. 17, the lever is broken away from the virgin seal 42 along the breaking edges 93.

As shown in FIG. 12, an annular valve seat 96 is integrally formed on the upper end of the piston 14. A secondary valve 98 and valve spring 100 wavy in vertical section are formed integrally of plastics material. A positioning plate 102 is integrally formed on the upper end of the valve spring 100, and a fall preventive rod 104 is integrally formed extending from the secondary valve 98 downwardly. In this way, if the secondary valve 98 and valve spring 100 are formed integrally, the number of the parts employed is reduced and the assembling operation can be easily carried out. Since the valve spring 100 is formed of plastics material, there is no fear that it is eroded by the liquid to be issued.

The assembling procedure and the operation of the dispenser 70 having the above-mentioned construction will now be described. First, the assembling procedure is described. The "virgin-lock" should be made for preventing the depression of the head 36 at a time preceding to the commencement of the actual use of the dispenser. The assembling procedure for the head 36, virgin seal 42 and cap 24 are performed, for example, as follows. First the virgin seal 42 is attached, from above, to the cap 24 so that its engagement groove 92 may be brought into engagement with the engagement projection 76 of the cap. In the state wherein the engagement groove 92 is engaged with the engagement projection 76, the engagement projection 88 of the virgin seal 42 is aligned with the triangular notch 75 of the engagement groove 71 of the cap 24. Then, the head 36 is attached, from above, to the cap 24. The head 36 is attached to the cap 24 so that the triangular portion 79 of the head 36 may not be aligned with the engagement projection 88 of the virgin seal 42. Thereafter, by rotating the head, its triangular portion 79 is brought into engagement with the triangular notch 75 of the cap 24, and at the same time the engagement projection 88 of the virgin seal 42 into engagement with the window 80 of the head 36. In this state, the rotation of the virgin seal 42 is prevented by engagement of the engagement groove 92 with the engagement projection 76 of the cap 24. Further, the head 36 is disabled from rotating relative to the virgin seal 42 by having the engagement projection 88 of the virgin seal brought into engagement with its window 80. Accordingly, the rotation of the head 36 relative to the cap 24 is prevented indirectly. Further, by engagement of the triangular portion 79 with the triangular notch 75 of the engagement groove 71 of the cap 24, the head 36 is prevented from making an upward movement. Thus, the rotation and rising movement of the head 36 are prevented with a result that the virgin-lock is completed. Thereafter, the piston 14 is attached, from below, to the head 36 jointly with the secondary valve 98, and the cylinder 12 having the primary valve 22 and the compression coil spring 34 received therein is pushed, from below, in the cap 24. Thus, the assembling operation of the dispenser is completed. The dispenser thus assembled is screwed onto the vessel 29 containing the liquid to be dispensed, and is suitable packed and transported. The above-mentioned assembling procedure for the head 36, virgin seal 42 and cap 24 is only one example, and other procedures may be adopted, such as that of aligning the triangular portion 79 of the head 36 with the engagement projection 88 and the notch 75, and pressing the head 36 so as to cause the triangular portion 79 and the window 80 of the head to be forcibly engaged with the notch 75 and the engagement projection 88, respectively, by utilizing the elasticity of the plastics material.

Figure 19:
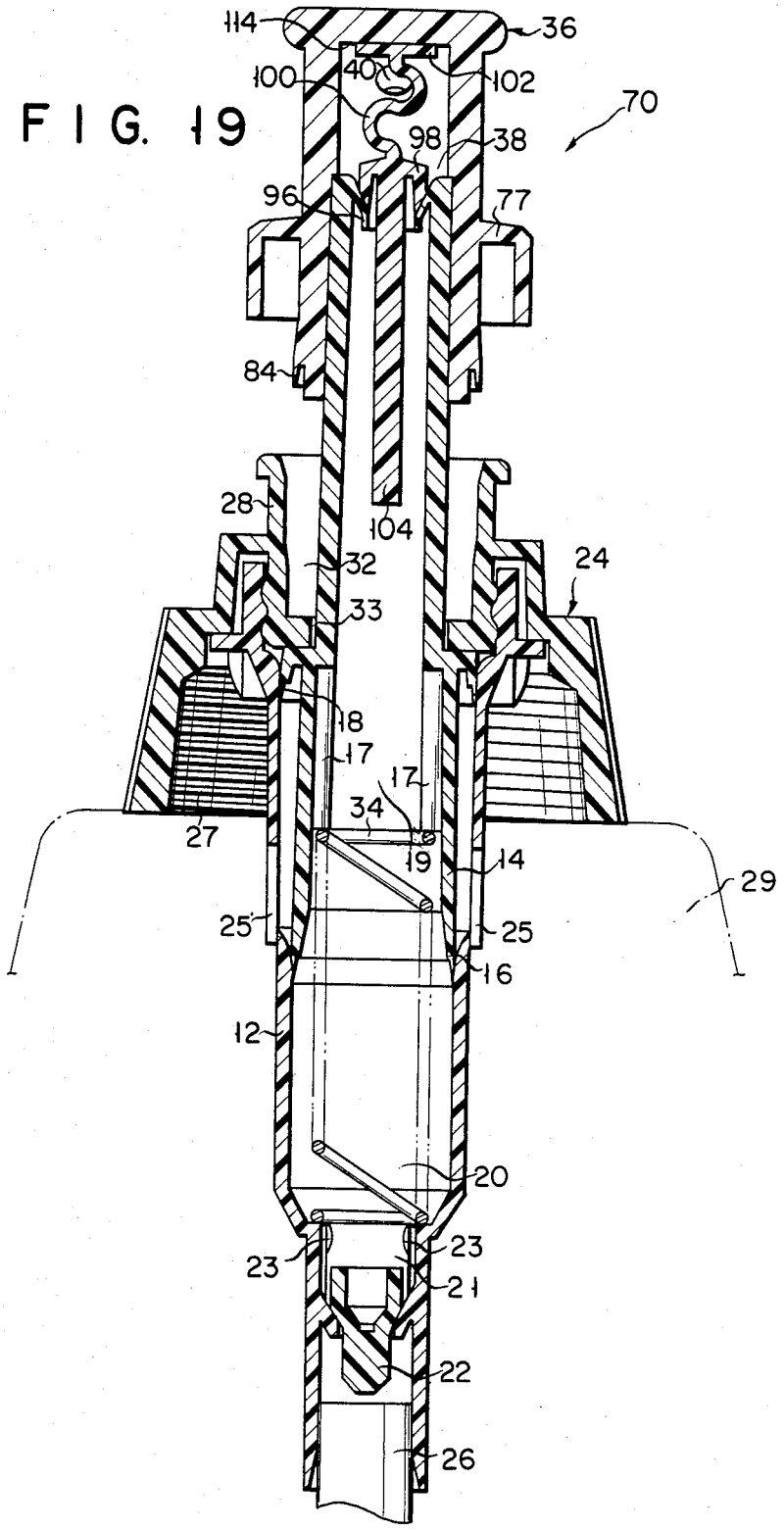
FIG. 19 is a longitudinal sectional view of the dispenser shown in FIG. 12, wherein the head is located at the raised position and previously rotated in the clockwith through an angle of 90° as viewed from above the head.

In advance of starting the actual use of the dispenser, the virgin lock is released. When the lever 94 of the virgin seal 42 is rocked in the arrow-indicated direction of FIG. 17, the breaking edges 93 connecting the virgin seal and the lever are broken. Thus, the virgin seal 42 can be removed from the dispenser 70. When the virgin seal 42 is removed, the head 36 is made rotatable. Therefore, by rotating the head in the 'OPEN' direction, the triangular portion 79 of the head is released from the engagement groove 71 of the cap 24. Since the head 36 is pushed by the urging force of the compression coil spring 34 in the direction in which the piston 14 is protruded, namely in the upward direction, it is moved, upon the release, to its protruded position shown in FIG. 19, that is, its raised position at which the issuing operation is possible. It is to be noted, however, that in FIG. 19 the head 36 is already rotated through an angle of 90° from the state shown in FIG. 12 in the clockwise direction as viewed from above the head.

The liquid issuing operation of the dispenser 70 is carried out as follows. When the piston 14 is protruded or is allowed to rise jointly with the head 36, a negative pressure is produced in the variable chamber 20 due to an increase in the volume of the same. For this reason, the primary valve 22 rises against its own weight and is thus separated from the valve seat. By the opening of the primary valve 22, the liquid in the vessel 29 is sucked into the variable chamber 20 through the suction pipe 26. Thereafter, when the head 36 is depressed against the urging force of the spring 34, the liquid in the variable chamber 20 is pressurized. When the pressure of the liquid thus pressurized has become greater than the urging force of the valve spring 100 of the secondary valve 98, this secondary valve 98 is separated from the valve seat 96. Thus, the pressurized liquid is issued from the orifice 39 through the flow paths 38 and 40. When the pressure of the pressurized liquid decreases due to the issue thereof and becomes smaller than the urging force of the valve spring 100, the secondary valve 98 is pressed against the valve seat 96. Thus, the issue of the liquid is completed. Thereafter, by removing the depressing force from the head 36, the head is returned to its raised position by the urging force of the compression coil spring 34. At this time, the liquid is again sucked up, thereby preparing for the next issuing operation.

In this embodiment, the virgin seal 42 is only prevented from making a rotation relative to the cap 24 and no measures are taken to prevent the virgin seal from making an upward movement. It will be apparent, however, that the virgin seal 42 may be attached to the cap 24 so as to be neither rotated nor raised. If the virgin seal 42 is disabled from being rotated and raised, the head 36 may be engaged with the virgin seal and not with the cap 24. For example, if the engagement projection 76 of the cap is made partially spherical as indicated in one-dot chain line of FIG. 13 and the engagement groove 92 of the virgin seal 42 is formed into such a circular groove as cab be forcibly engaged with the partially spherical engagement projection 76 (see FIG. 17), the virgin seal 42 can be attached to the cap 24 so that it may not be rotated and raised relative to the same. And if the window 80 of the head 36 is forcibly engaged with the engagement projection 88 of the virgin seal 42, since the width of the engagement projection 88 is made slightly smaller than that of the window 80 to provide only a small clearance therebetween, the rotation of the head relative to the virgin seal is prevented without play existing therebetween. Further, by abutment of the shoulder portion 90 of the engagement projection 88 against the lower edge of the window 80, the rising movement of the head 36 is prevented.

Figure 20:
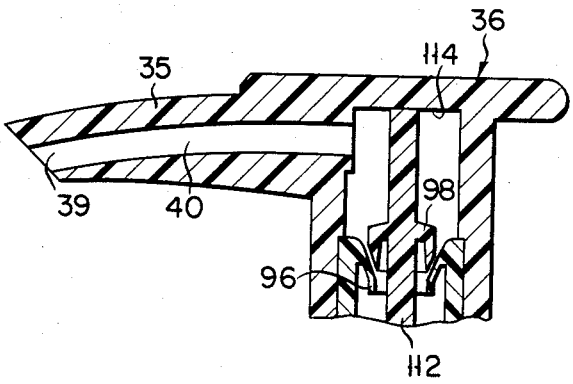
FIGS. 20 and 21 are partial longitudinal views of the upper and lower parts of the dispenser shown in FIG. 12 so modified as to forcibly press the primary valve by the valve spindle, respectively.
Figure 21:
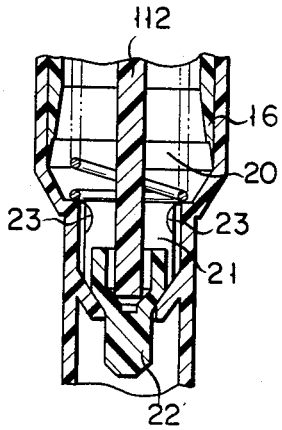

Further, the relationship of the engagement projections 76 and 88 with their corresponding engagement grooves 92 and 80 (window) may be reversed from that established in this embodiment. That is, for example, while in this embodiment the engagement projection 76 and the engagement groove 92 are formed on the cap 24 and in the virgin seal 42, respectively, it is apparent that they may be formed on the virgin seal and in the cap, respectively. Further, the number, circumferential position and the shape or configuration of the engagement projections and engagement grooves may be altered, if necessary. Further, the inner circumferential surface of the cap 24, on which the skirt-like seal 84 formed at the lower end portion of the outer circumferential surface of the head 36 slides, may be made not stepped but straight, and formed with a negative pressure preventive hole 106 (see FIG. 12). Further, such a construction as to forcibly press the primary valve 22 onto the valve seat may be given. To this end, the fall preventive rod 104 of the secondary valve 98 may be vertically extended and made to act as the valve spindle 112 (see FIG. 20). That is, the valve spindle 112 is constructed so that, when the piston 14 is located at its depressed position or lowered position, it may forcibly press the primary valve 22 onto the valve seat (see FIG. 21). That is, in this embodiment, when the piston 14 is located at its lowered position, the valve spindle 112 is downwardly pressed by abutment of its upper end against the inner wall surface 114 of the head 36, and its lower end forcibly pressed the primary valve 22 onto the valve seat. In this construction, even if the vessel 29 falls with a result that a force upwardly pressing the primary valve 22 is created, it is inconceivable that this force is greater than the pressing force of the valve spindle 112. Therefore, it is impossible that the valve spindle 112 permits the primary valve 22 to be released or separated from the valve seat. Accordingly, it is impossible that the liquid in the vessel 29 is erroneously allowed to flow into the cylinder 12 through the primary valve 22. Thus, the unnecessary issue of the liquid into outside the dispenser is completely prevented. It is to be noted here that, although the valve spindle 112 is constructed so that it may forcibly press the primary valve 22 onto the valve seat, it is also constructed so that a clearance may be provided between the secondary valve 98 and the valve seat 96. If in this way the secondary valve 98 is kept separated from the valve seat 96, the residual air in the variable chamber 20 can be removed easily. That is, when the locked state is released as later described for purpose of the issuing operation, the head 36 and the piston 14 are allowed to rise by the urging force of the spring 34, thereby causing an increase in the volume of the variable chamber 20. Thus, a negative pressure is created in the variable chamber 20. At this time, a clearance is produced between the upper end of the valve spindle 112 and the inner surface 114 of the head 36. When the piston 14 rises, the valve seat 96 formed on the piston is allowed to abut on the secondary valve 98. Thus, the secondary valve and valve spindle 112 are allowed to rise jointly. For this reason, the restriction of the primary valve 22 by the valve spindle 112 is released with a result that, due to the negative pressure in the variable chamber 20, the primary valve is separated from its valve seat to permit the liquid in the vessel 29 to flow into the variable chamber 20. It is to be noted here that the secondary valve 98 is only supported on the valve seat 96. For this reason, the residual air in the variable chamber is pushed away by the liquid thus flowed thereinto to push up the secondary valve 98 and separate the same from the valve seat 96. Thus, the residual air escapes from the dispenser through the clearance created between the secondary valve 98 and valve seat 96. The force acting to obstruct the secondary valve 98 from being pushed up away from the valve seat 96 is solely the weight of the secondary valve itself and this resistance force of the secondary valve is extremely small as compared with the urging force of the valve spring which acts when this valve spring presses the secondary valve 98 onto the valve seat 96. For this reason, said residual air is easily allowed to escape from the dispenser without receiving any substantial resistance. Thus, the residual air can be quickly and easily removed, thereby obtaining the predetermined issuing operation very quickly.

Figure 22:
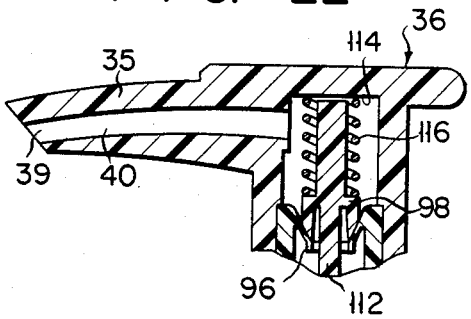
FIG. 22 is a partial longitudinal view similar to FIG. 20, wherein a valve spring is disposed.

In this embodiment, when the head 36 is locked to its lowered position, the clearance is provided between the secondary valve 98 and the valve seat 96. Therefore, if the liquid is left in the variable chamber 20, there is a fear that at the time of, for example, a fall of the vessel 29, this residual liquid issues through the clearance. Therefore, as shown in FIG. 22, the dispenser may be arranged such that when the head 36 is locked to its lowered position, the secondary valve 98 is pressed onto the valve seat 96 by the urging force of a compression coil spring 116 acting as a valve spring. In this arrangement, since the secondary valve 98 is closed, the issue of the residual liquid from the dispenser can be prevented. On the other hand, however, since in such an arrangement the urging force of the valve spring 116 acts on the secondary valve 98, the residual air is not so quickly discharged as in case of the construction shown in FIGS. 20 and 21.

In the construction of providing the clearance between the secondary valve 98 and the valve seat 96, while there is a fear that the residual liquid in the variable chamber 20 is allowed to issue from the dispenser through the secondary valve, there is a merit that the residual air can be easily discharged. In this case, however, it is only the residual liquid that is likely to issue, no fear existing that the whole liquid escapes from through the primary valve 22. On the other hand, in the construction of pressing the secondary valve 98 onto the valve seat 96 by means of the valve spring 116, there is no fear that the residual liquid is allowed to issue through the secondary valve. In this case, however, discharge of the residual air is not easy. This difficulty can be resolved by determining the construction of the secondary valve 98 according to, for example, the nature of the liquid. For example, with regard to the dispenser used for poisonous liquid such as insecticide, unnecessary issue thereof should be sufficiently prevented so as to cause no accident and therefore the construction of pressing the secondary valve 98 onto the valve seat 96 should be adopted at the sacrifice of the discharge of the residual air.

Figure 23:
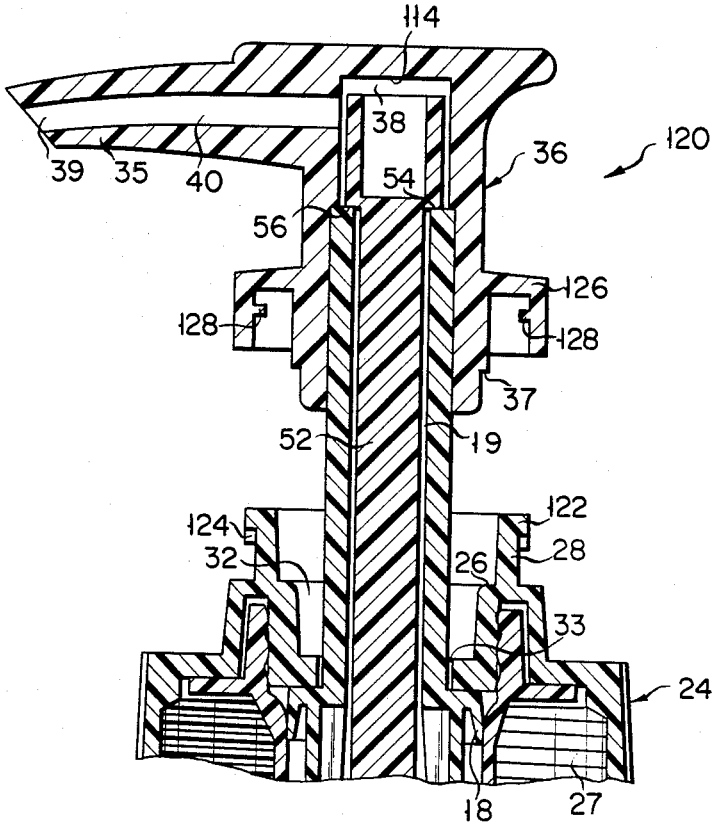
FIG. 23 is a longitudinal sectional view of the dispenser according to a fourth embodiment of the invention, wherein the head is located at the raised position.
Figure 24:
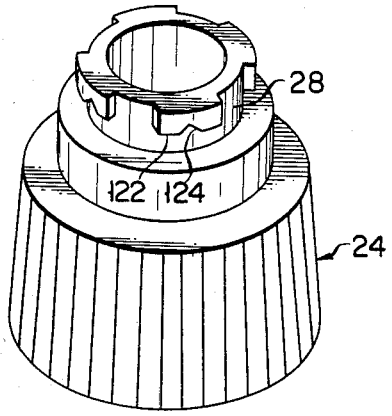
FIG. 24 is a perspective view of the cap.
Figure 25:
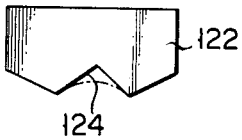
FIG. 25 is a front view showing a modification of the protruded portion of the cap.

In FIG. 23, the dispenser 120 according to a fourth embodiment of the invention is shown. In this dispenser 120, four projections 122 are formed on the outer circumferential surface of the upper end of the annular protruded portion 28 of the cap 24, at their circumferentially equidistant positions, and are formed with triangular engagement grooves 124 at the centers of their undersides (see FIG. 24). It is sufficient that the projection 122 is provided at least one in number, and it is not limited to four in number illustrated in this embodiment. The projection may be varied in number if the necessity arises. Further, the underside of this projection may be formed into such an inclined shape as shown in FIG. 25. Further, the engagement groove 124 is not limited to the triangular configuration, but may be formed into other configurations such as a partially circular configuration shown in one-dot chain line of FIG. 25. On the other hand, the head 36 is integrally formed with a bottomed cylindrical body 126, which has two engagement projections 128 circumferentially equidistantly formed on the inner circumferential surface of its side wall. These projections 128 are made engageable with the engagement grooves 124 of the said projections 122. The number of the engagement projections 128 is not limited to two, but may be varied if that necessaity arises.

When the head 36 of the dispenser 120 having the construction is depressed against the urging force of the sring 34 (see FIG. 1), the piston 14 is lowered jointly with the head 36. When the head 36 is lowered, the engagement projection 128 of the bottomed cylindrical body 126 integrally formed with the head is lowered passing between the projections 122 formed on the annular protruded portion 28. And after the head 36 is lowered and its shoulder portion 37 abuts on the upper surface 26 of the cap 24, the head is rotated so that the engagement projection 128 may be located beneath the engagement groove 124 of the projection 122. It is to be noted here that the direction in which the head 36 is rotated may be rightward or leftward. Thereafter, when the force of depressing the head 36 is removed, the head is slightly allowed to rise by the urging force of the spring 34. Thus, the engagement projection 128 is brought into engagement with the engagement groove 124. By engagement of the engagement projection 128 with the engagement groove 124, the head 36 and the piston are prevented from making their rising movements. Thus, the piston is locked to its lowered position.

Figure 26:
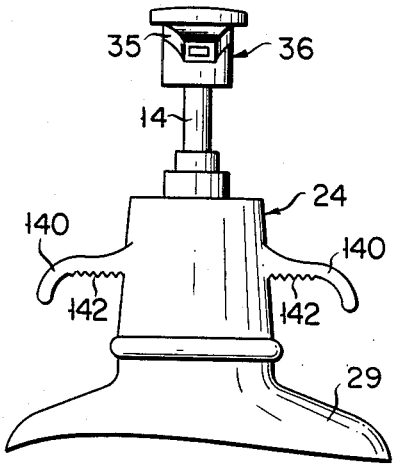
FIGS. 26 and 27 are a front view, and a right side view, of the dispenser of the invention provided with a hanger, respectively.
Figure 27:
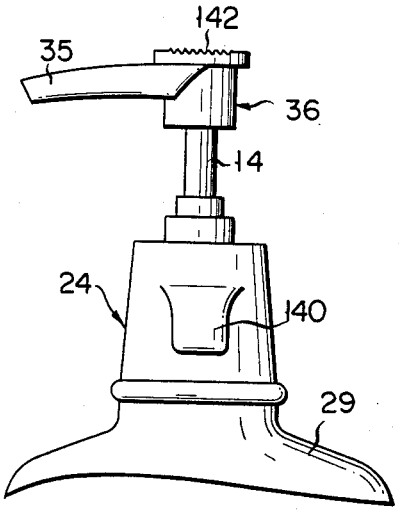

In the above-mentioned embodiments, as shown in FIGS. 26 and 27, the dispenser is preferably provided with a hanger 140 for making its liquid issuing operation easy. The dispenser is provided, for example, with a pair of hangers 140 extending from the outer circumferential surface of the cap 24 in the radially outward direction and formed so that the fingers of an operator may be engaged with the hangers. These hangers 140 are extended in mutually opposite directions and their respective extended end portions are downwardly bent so as to ensure the engagement of the operator's fingers with the hangers. The respective undersides of the hangers 140 and the upper surface of the head 36 are formed with slip resistances, respectively, such as mesh patterns made by knurling fabrication. And the extended length of the hanger 140, the distance between the curved surface of the extended end portion of the same and the upper surface of the head 36, and the distance between the underside of the hanger and the upper surface of the head 36 are respectively set at appropriate values as measured from the viewpoint of human engineering.

When the liquid issuing operation is carried out using the dispenser having the construction, the vessel 29 is lifted by, for example, hanging the operator's index finger and middle finger on the hanger 140 from below. After the nozzle 35 is turned in the direction in which the liquid is to be issued, the upper surface of the head 36 is depressed by the thumb. Within the cylinder, the piston is thereby allowed to slide downwardly to pressurize the liquid. The liquid is thus allowed to issue from the dispenser through the nozzle 35.

In this way, since the dispenser is provided with the hangers 140, the operator, with the dispenser lifted by his one hand, can easily carry out his issuing operation.

Figure 28:
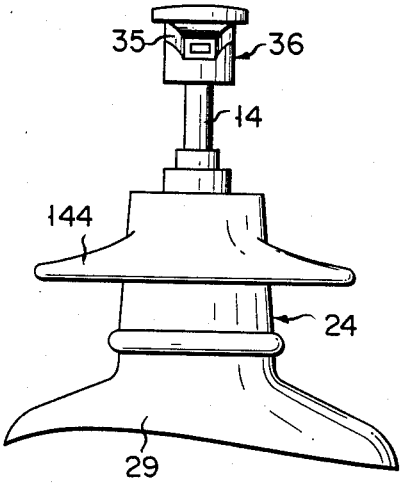
FIGS. 28 and 29 are a front view, and a plan view, of the dispenser of the invention provided with another hanger, respectively.
Figure 29:
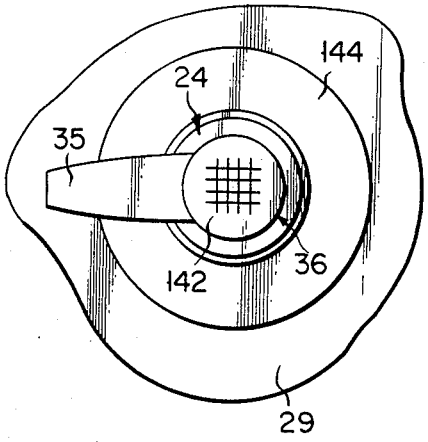

In the embodiment, description was made of the hangers 140 extending in mutually opposite directions. As shown in FIGS. 28 and 29, however, the hanger may be of the annular type 144 extending from the outer circumferential surface of the cap 24 in the radially outward direction thereof. With regard to the hanger 144, the extended length thereof, the distance between the underside thereof and the upper surface of the head 36, etc. are respectively set at appropriate values as measured from the viewpoint of human engineering, as in the above-mentioned embodiment.

Since this dispenser is also provided with the hanger 144, it has the same action and effect as in the preceding embodiment. Since this hanger 144 is formed annular, the operator can, in accordance with the direction of the nozzle 35, hang his fingers on the hanger at his free position and quickly perform his issuing operation.

What is claimed is:

1. A dispenser having a cap, a head, a piston attached to the head and a cylinder attached to the cap, and which is constructed so that it may be fitted onto a vessel through the cap and so that it may, in accordance with the sliding movement of the piston, suck up a liquid in the vessel into the cylinder through a primary valve and pressurize the liquid to cause the same to issue from the dispenser through a secondary valve, the dispenser further comprising:

child-proofing means including a protruded portion formed on the cap and having an engagement groove, and an engagement projection formed on the inner wall surface of the head and, by being rotated with the piston located at its depressed position, engaged with said engagement groove of said protruded portion to lock the piston made integral with the head to its depressed position;

one of an engagement projection and an engagement groove formed on or in, respectively, the outer wall surface of the cap;

the other of an engagement groove and an engagement projection formed in or on, respectively, the head so that it may be engaged with said engagement projection or engagement groove of the cap; and means for preventing the rotation and rising movement of the head, said preventing means being formed on a virgin seal removably disposed between the cap and the head;

said preventing means for preventing the rotation and rising movement of the head including first engagement means engaged, by being moved in the direction of depressing the piston, with said engagement projection or engagement groove of the cap to prevent at least the rotation of the virgin seal relative to the cap, and second engagement means engaged, by being depressed in the direction of depressing the piston, with said engagement projection or engagement groove of the head to prevent at least the rotation of the head relative to the virgin seal.

2. The dispenser according to claim 1, wherein the head has seal means brought, with the piston located at its depressed position, into liquid-tight engagement with an inner face of the cap, thereby making ineffective the communication between the interior of the vessel and the exterior thereof.

3. The dispenser according to claim 1, wherein:

said head is attached to an upper end portion of said piston and makes a reciprocating movement integrally with said piston;

said cap is attached to a mouth portion of said vessel;

said virgin seal is made of plastic material and has a first engagement portion for being engaged with said head and a second engagement portion for being engaged with said cap, said virgin seal locking said piston to a depressed position thereof, and said virgin seal further having an exfoliating groove formed therein in the direction of orientation of said plastic material and enabling the separation of said virgin seal in said direction of orientation of said plastic material.

4. The dispenser according to claim 3, wherein said virgin seal is formed into a bottomed-cylindrical body and has a projection at a position adjacent to said exfoliating groove such that said projection of said virgin seal projects from a side wall of said virgin seal.

5. The dispenser according to claim 4, wherein said virgin seal has a plurality of said exfoliating grooves arranged in two substantially parallel columns; said projecting of said virgin seal is located between said two parallel columns perpendicularly to the arrangement of said exfoliating grooves; and said virgin seal further includes a rib substantially parallel with the arrangement of said exfoliating grooves and arranged between said projection and a side wall of said virgin seal.

* * * * *